US010811182B2

(12) United States Patent
Kim et al.

(10) Patent No.: US 10,811,182 B2
(45) Date of Patent: Oct. 20, 2020

(54) INDUCTOR AND METHOD OF MANUFACTURING THE SAME

(71) Applicant: SAMSUNG ELECTRO-MECHANICS CO., LTD., Suwon-si, Gyeonggi-do (KR)

(72) Inventors: Soo Yeol Kim, Suwon-si (KR); Jong Seok Bae, Suwon-si (KR); Se Woong Paeng, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 241 days.

(21) Appl. No.: 15/618,585

(22) Filed: Jun. 9, 2017

(65) Prior Publication Data

US 2018/0122553 A1 May 3, 2018

(30) Foreign Application Priority Data

Oct. 28, 2016 (KR) ..... 10-2016-0142292
Nov. 18, 2016 (KR) ..... 10-2016-0154207

(51) Int. Cl.

| | |
|---|---|
| ***H01F 27/29*** | (2006.01) |
| ***H01F 27/28*** | (2006.01) |
| ***H01F 17/00*** | (2006.01) |
| ***H01F 41/04*** | (2006.01) |
| ***H01F 41/12*** | (2006.01) |

(52) U.S. Cl.

CPC ..... *H01F 27/2804* (2013.01); *H01F 17/0013* (2013.01); *H01F 27/29* (2013.01); *H01F 41/041* (2013.01); *H01F 41/125* (2013.01); *H01F 27/292* (2013.01); *H01F 2017/002* (2013.01)

(58) Field of Classification Search

CPC ..... H01F 5/00; H01F 27/00–40
USPC ..... 336/65, 83, 200, 206–208, 232–234
See application file for complete search history.

(56) References Cited

U.S. PATENT DOCUMENTS 6,534,723 B1 3/2003 Asai et al.
8,692,135 B2 * 4/2014 Funaya ..... H01L 23/49827 174/264
9,204,541 B2 12/2015 Chisaka et al.
10,147,533 B2 12/2018 Lyoo et al.
(Continued)

FOREIGN PATENT DOCUMENTS

CN 1338117 A 2/2002
CN 1461495 A 12/2003
(Continued)

OTHER PUBLICATIONS

First Office Action dated Jul. 2, 2020 in corresponding Chinese Patent Application No. 201710654714.8 (with English translation).

*Primary Examiner* — Tuyen T Nguyen
(74) *Attorney, Agent, or Firm* — Morgan, Lewis & Bockius LLP

(57) ABSTRACT

An inductor includes a body in which is disposed a coil connecting a plurality of coil patterns by a via. The via includes a first conductive layer and a second conductive layer disposed on the first conductive layer, and the via has an upper portion having a transverse cross-sectional area that is greater than a transverse cross-sectional area of a lower portion thereof. An interlayer contact area of coils may be increased, thereby improving electrical characteristics and connection reliability.

27 Claims, 7 Drawing Sheets

(56) References Cited

U.S. PATENT DOCUMENTS

2004/0038519 A1 2/2004 Yanagisawa et al.
2005/0161833 A1* 7/2005 Takeuchi ..... H01L 21/568 257/775
2006/0283625 A1* 12/2006 Yamamichi ..... H01L 21/486 174/255
2011/0155433 A1 6/2011 Funaya et al.
2013/0068513 A1* 3/2013 Hirai ..... H05K 3/4069 174/257
2013/0223033 A1 8/2013 Mano et al.
2013/0299219 A1* 11/2013 Chisaka ..... H05K 1/0271 174/257
2013/0300529 A1 11/2013 Chang et al.
2013/0342301 A1* 12/2013 Mano ..... H01F 27/2804 336/200
2014/0049353 A1* 2/2014 Yoon ..... H01F 27/28 336/227
2014/0091892 A1* 4/2014 Tominaga ..... H05K 1/165 336/200
2014/0293529 A1 10/2014 Nair et al.
2015/0084730 A1* 3/2015 Lee ..... H01F 17/0013 336/200
2016/0293451 A1* 10/2016 Koelling ..... B22F 1/0014
2016/0351321 A1* 12/2016 Lyoo ..... H01F 27/2804
2017/0200551 A1* 7/2017 Paeng ..... H01F 41/041
2018/0301277 A1* 10/2018 Paeng ..... H01F 17/0013

FOREIGN PATENT DOCUMENTS

CN 103298256 A 9/2013
CN 103404239 A 11/2013
CN 104078451 A 10/2014
CN 104349592 A 2/2015
CN 104910823 A 9/2015
CN 106205954 A 7/2016
CN 105914015 A 8/2016
JP 08148828 A * 6/1996
JP 2001-217550 A 8/2001
JP 2003-243816 A 8/2003
JP 2004-296992 A 10/2004
JP 2007-103736 A 4/2007
WO 2010024233 A1 3/2010
WO 2012/111711 A1 8/2012

* cited by examiner

INDUCTOR AND METHOD OF MANUFACTURING THE SAME

CROSS-REFERENCE TO RELATED APPLICATION(S)

This application claims benefit of priority to Korean Patent Applications No. 10-2016-0142292 filed on Oct. 28, 2016 and No. 10-2016-0154207 filed on Nov. 18, 2016 in the Korean Intellectual Property Office, the disclosures of which are incorporated herein by reference in their entireties.

BACKGROUND

1. Field

The present disclosure relates to an inductor and a method of manufacturing the same.

2. Description of Related Art

General laminated inductors have a structure in which a plurality of insulating layers having conductor patterns formed thereon are laminated. Such conductor patterns are sequentially connected to each other through conductive vias formed in the respective insulating layers to be superimposed in a lamination direction, thereby forming coils having a helical structure. Both ends of the coils are exposed to outer surfaces of laminates and connected to external terminals.

Inductors are commonly surface mount device-types (SMD types) mounted on circuit boards. In the case of high-frequency inductors used at a high frequency of 100 MHz or more, the usage thereof in the communications markets is increasing.

The most important characteristic of high frequency inductors may be to secure quality factor (Q) characteristics indicating efficiency of chip inductors, where Q=wL/R, and a Q value refers to the ratio of inductance (L) and resistance (R) in a given frequency band w.

Since inductors are manufactured to have a specific inductance, implementing relatively high Q characteristics at the same inductance may be required. In order to increase Q characteristics at the same inductance, it may be necessary to lower resistance (R). In order to lower the resistance (R), thicknesses of coil patterns should be increased.

The magnitude of resistance may be changed depending on lengths and cross-sectional areas of coil conducting wires. As lengths of conducting wires are increased, resistance is increased, and as cross-sectional areas of conducting wires are increased, resistance is reduced.

In order to reduce resistance of an inductor, a cross-sectional area of a coil should be increased. In a method of manufacturing a multilayer inductor, a via is formed to connect coils to each other and the interlayer connection is performed by filling the via with metal.

In the related art, a cross-sectional shape of a metal bump is rectangular, following a via shape. However, since a connection area may be limited when connecting layers, the alignment between the layers may not be matched and connectivity may thus be deteriorated.

A need therefore exists for an inductor having a structure by which the problem as described above may be solved.

SUMMARY

An aspect of the present disclosure is to provide an inductor and a method of manufacturing the same.

According to an aspect of the present disclosure, an inductor includes a body in which a coil connecting first and second coil patterns by a via is disposed. The via includes a first conductive layer and a second conductive layer disposed on the first conductive layer, and the via has an upper portion having a transverse cross-sectional area that is greater than a transverse cross-sectional area of a lower portion of the via.

According to another aspect of the present disclosure, a method of manufacturing an inductor includes steps for forming a coil pattern on a substrate, and forming an insulating layer on the substrate to cover the coil pattern. A through-hole is formed in the insulating layer, the through-hole having an upper portion having a transverse cross-sectional area that is greater than a transverse cross-sectional area of a lower portion of the through-hole. The lower portion of the through-hole contacts the coil pattern. A first conductive layer is formed within the through hole, to exceed an upper surface of the insulating layer. A second conductive layer is formed by printing a conductive paste on an upper portion of the first conductive layer. The substrate is separated from the insulating layer including the coil pattern and the first and second conductive layers. A body is formed to include a coil composed of a via including the coil pattern and the via comprising the first and second conductive layers connected to the coil pattern by laminating a plurality of the separated insulating layers.

According to another aspect of the present disclosure, a body includes first and second conductive patterns disposed in different planes, and a conductive via extending between and electrically connecting the first and second conductive patterns. A contact area of the conductive via with the first conductive pattern is larger than a contact area of the conductive via with the second conductive pattern.

According to a further aspect of the present disclosure, an inductor includes a body formed of an insulating material, a coil disposed in the body, and first and second electrodes disposed on external surfaces of the body and connected to respective ends of the coil. The coil includes first and second coil patterns connected by a conductive via. The includes a first conductive layer contacting the first coil pattern and a second conductive layer disposed on an arced surface of the first conductive layer and contacting the second coil pattern. The first and second conductive layers have different compositions. The conductive via including the first and second conductive layers has a tapered profile gradually expanding between a small cross sectional area of the first conductive layer contacting the first coil pattern and a larger cross sectional area of the second conductive layer contacting the second coil pattern.

The above and other aspects, features, and advantages of the present disclosure will be more clearly understood from the following detailed description taken in conjunction with the accompanying drawings, in which:

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
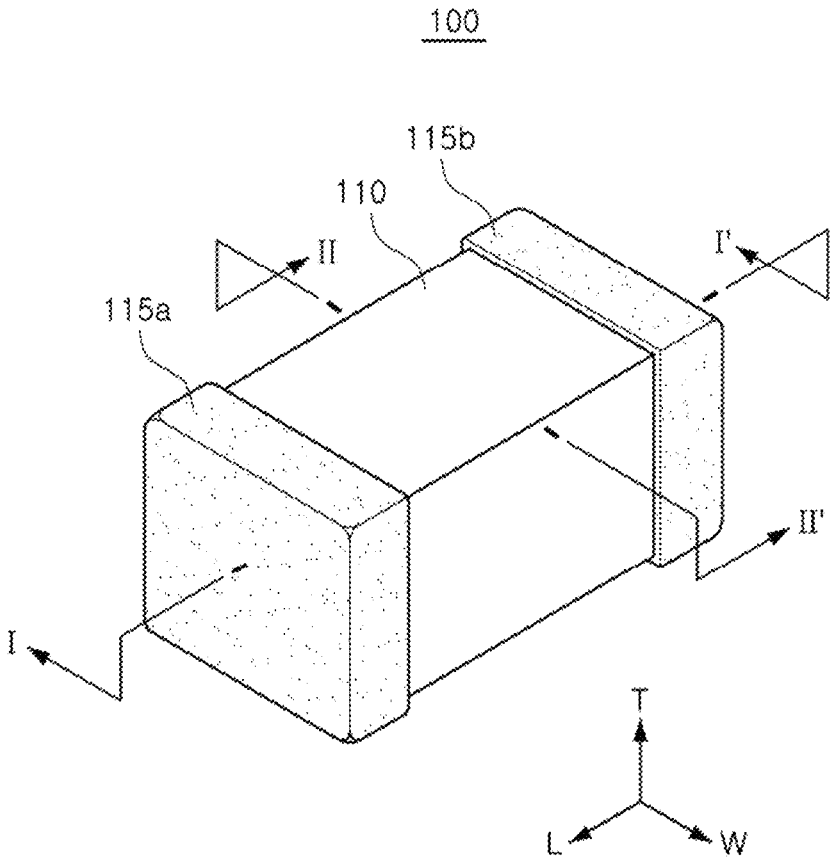
FIG. 1 is a schematic perspective view of an inductor according to an exemplary embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the embodiments.

Spatially relative terms, such as "above," "upper," "below," and "lower" and the like, may be used herein for ease of description to describe one element's positional relationship to other element(s) in the orientation shown in the figures. It will be understood that the spatially relative terms are intended to encompass different orientations of the device in use or operation in addition to the orientation depicted in the figures. For example, if the device in the figures is turned over, elements described as "above" or "upper" relative to other elements would then be oriented "below" or "lower" relative to the other elements or features. Thus, the term "above" can encompass both upward and downward orientations, depending on a particular direction of the figures or device. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views shown in the drawings and illustrating embodiments of the present disclosure. In the drawings, components having ideal shapes are shown. However, variations from these ideal shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The contents of the present disclosure described below may have a variety of configurations and only illustrative configurations are shown and described herein. However, the disclosure is not limited to the particular illustrative configurations shown and described.

Hereinafter, an inductor 100 according to an exemplary embodiment will be described.

Figure 2:
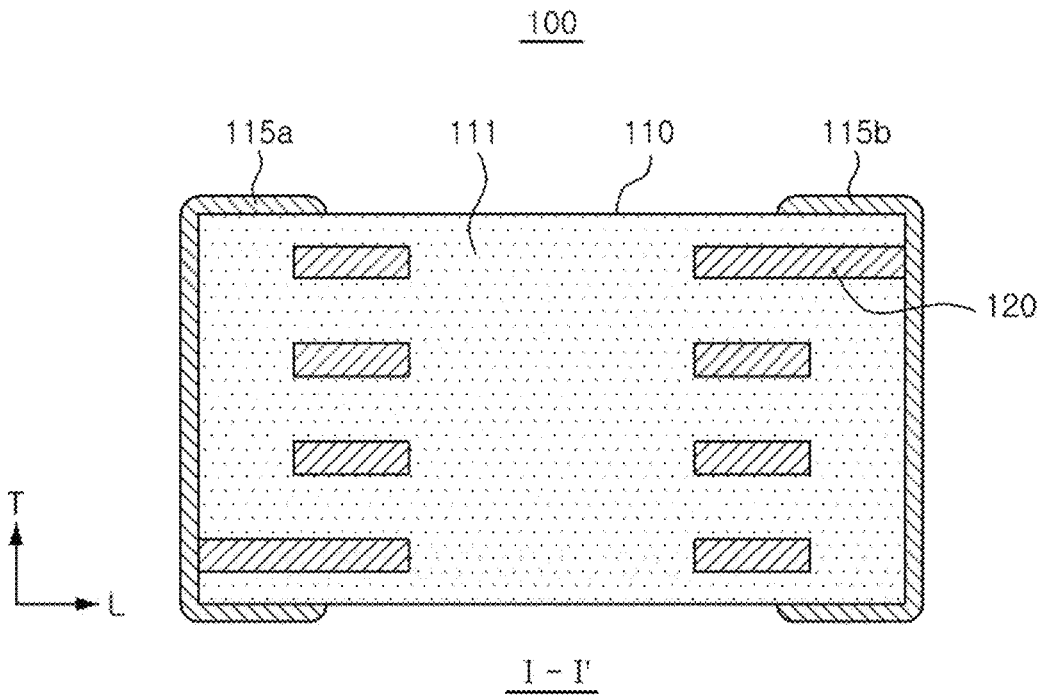
FIG. 2 is a schematic cross-sectional view of the inductor, taken along line I-I' of FIG. 1, according to the exemplary embodiment.
Figure 3:
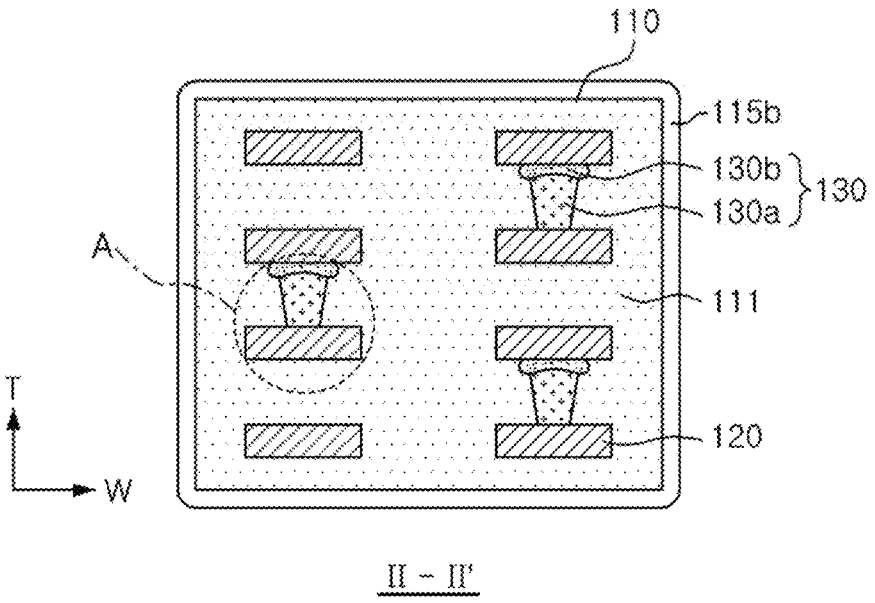
FIG. 3 is a schematic cross-sectional view of the inductor, taken along line II-II' of FIG. 1, according to the exemplary embodiment.

FIG. 1 is a schematic perspective view of an inductor according to an exemplary embodiment, FIG. 2 illustrates a schematic cross-sectional view of the inductor according to the exemplary embodiment taken along line I-I' of FIG. 1, and FIG. 3 illustrates a schematic side cross-sectional view of the inductor according to the exemplary embodiment taken along line II-II' of FIG. 1.

With reference to FIGS. 1 to 3, the inductor 100 according to the exemplary embodiment may include a body 110 in which a coil 120 formed by connecting a plurality of coil patterns by one or more via(s) 130 is disposed therein. The via(s) 130 may each include a first conductive layer and a second conductive layer formed on the first conductive layer, and the second conductive layer may include a conductive powder and an organic material.

The body 110 may include a first main surface, a second main surface, and a side surface connecting the first main surface and the second main surface to each other, although not shown. The side surface may be a surface in a direction perpendicular to a direction in which insulating layers are laminated.

In the case of an inductor according to the related art, a body is formed by laminating and sintering a plurality of ceramic layers on which coil patterns are formed. In this case, cracks or delamination between layers may occur, due to a step difference between a portion on which a coil pattern is formed and a portion on which a coil pattern is not formed.

In the case of the inductor 100 according to an exemplary embodiment, the body 110 may be formed of an insulating material. Since the body is formed of an insulating material, a step due to the coil pattern may not occur, and defects such as cracks may be prevented.

In addition, since the inductor 100 (e.g., the body 110 of the inductor 100) according to an exemplary embodiment may have a relatively low dielectric constant, as compared with an inductor using a ceramic material (e.g., an inductor having a body using a ceramic material) according to the related art, parasitic capacitance may be reduced, and Q characteristics of the inductor may be secured.

The body 110 may be formed by laminating insulating layers.

The insulating material may be at least one of a photosensitive resin, an epoxy-based resin, an acrylic resin, a polyimide-based resin, a phenol-based resin, and a sulfone-based resin.

The insulating layers 111 may be integrated so that boundaries therebetween may not be easily confirmed after lamination and curing. A shape and dimensions of the body and the number of the laminated insulating layers therein are not limited to those illustrated in the exemplary embodiment.

The body 110 may include a coil therein.

The coil 120 may include, but is not limited to, a material containing silver (Ag) or copper (Cu), or an alloy thereof.

Ends of the coil 120 may be drawn to two sides of the body and may be electrically connected to external electrodes 115*a* and 115*b*.

The coil 120 may have a helical structure in which a plurality of coil patterns are sequentially connected to each other through one or more via(s) 130 to overlap each other in a laminating direction.

Different vias 130 may be spaced apart from each other between the insulating layers 111.

In this case, cover layer(s) (not shown) may be formed on at least one of upper and lower surfaces of the body 110 to protect the coil in the body 110.

The cover layer(s) may be formed by printing a paste of the same material as that of the insulating layer to a predetermined thickness.

In a general method of fabricating a multilayer inductor, a via is formed to connect coils, and an interlayer connection is performed by filling the via with a metal paste.

In the related art, a cross-sectional shape of a metal bump has a rectangular shape that follows a via shape. However, since a contact area is limited when connecting layers to each other, the alignment between the layers is not matched and connectivity may be deteriorated.

With reference FIG. 3, each via 130 of the inductor 100 according to an exemplary embodiment may include a first conductive layer 130*a* and a second conductive layer 130*b* formed on the first conductive layer 130*a*. In this case, each via 130 may have a form in which a transverse cross-sectional area of an upper portion thereof is greater than that of a lower portion thereof.

The via 130 has a form in which a transverse cross-sectional area of an upper portion thereof is greater than that of a lower portion thereof, which may indicate that as cross sections of the via 130 are increased from a lower portion thereof in contact with the coil pattern disposed therebelow toward an upper portion thereof.

In detail, for example, when it is assumed that the body is horizontally cut into parallel planes, section areas of cut upper and lower planes of the via 130 are different from each other, and a cross-sectional area of the upper portion thereof is greater than that of the lower portion thereof.

As a result, an interlayer connection area of the coil may be increased, and thus, electrical characteristics and connection reliability may be improved.

According to an exemplary embodiment, each via 130 may connect a coil pattern disposed therebelow to a coil pattern disposed thereabove to form the coil 120, and an area of contact between the via 130 and an upper coil pattern thereabove may be greater than an area of contact between the via 130 and a lower coil pattern therebelow.

For example, transverse cross-sectional areas of the via 130 may be gradually increased toward the upper portion thereof from the lower portion in contact with the lower coil pattern therebelow. In detail, the upper portion of the via 130 in contact with the upper coil pattern thereabove may have a maximum cross-sectional area.

The first conductive layer 130*a* may be formed of at least one of silver (Ag), copper (Cu), nickel (Ni), and tin (Sn). For example, a material of the first conductive layer 130*a* may be copper (Cu), but is not limited thereto.

The second conductive layer 130*b* may include a conductive powder and an organic material, and the conductive powder may be at least one of silver (Ag), copper (Cu), tin (Sn), and bismuth (Bi); or an alloy thereof.

The conductive powder may include two or more types of powder particles having different particle sizes.

For example, the conductive powder may be in a form including, but not limited to, particles of 3 μm size of tin (Sn) or bismuth (Bi) and particles of 1 μm size of silver (Ag). Particle sizes cited herein may correspond to an average size of particle, a median size of particle, a minimum size of particles, a maximum size of particles, a size such that 90% (or 95%) of particles exceed (or fall below) the cited size, a size such that 90% (or 95%) of particles fall within +/−5% (or 10%) of the cited size, or the like.

The organic material may be at least one of a polymer and a flux. The organic material may be one selected from, for example, epoxy, acrylate, and phenolic resin, but is not limited thereto.

According to an exemplary embodiment, the cross-sectional area of the via 130 is not particularly limited as long as a transverse cross-sectional area of an upper portion is greater than that of a lower portion, and for example, may have an inverted trapezoid or a fan shape.

In the case of a cross-section of the body 110 in a width-thickness direction (as shown in FIG. 3), the first conductive layer 130*a* of the via 130 may have a fan shape or other tapered shape.

As described later, in a process of manufacturing the body 110, the first conductive layer 130*a* may be formed in a through hole, in such a manner that the first conductive layer 130*a* extends beyond an upper surface of the insulating layer, thereby providing the structure thereof as described above. A more detailed description will be provided hereinafter.

In the case of a section of the body 110 in a width-thickness direction (as shown in FIG. 3), the first conductive layer 130*a* and the second conductive layer 130*b* may have a fan shape or other tapered shape.

For example, a cross section of the via 130 may have a fan shape in which a transverse cross-sectional area of an upper portion of the via 130 is greater than that of a lower portion thereof. In this case, the first conductive layer 130*a* and the second conductive layer 130*b* may have a fan-like shape whose upper surface is an arc shape.

External electrodes 115*a* and 115*b* may be disposed on both ends of the body 110.

External electrodes 115*a* and 115*b* may be formed using a material having excellent electrical conductivity and may include a conductive material such as silver (Ag) or copper (Cu), or an alloy thereof. However, exemplary embodiments are not limited thereto.

Surfaces of the external electrodes 115*a* and 115*b* formed as described above may be plated with nickel (Ni) or tin (Sn), as necessary, and thus, a plating layer may be further formed thereon.

Figure 4:
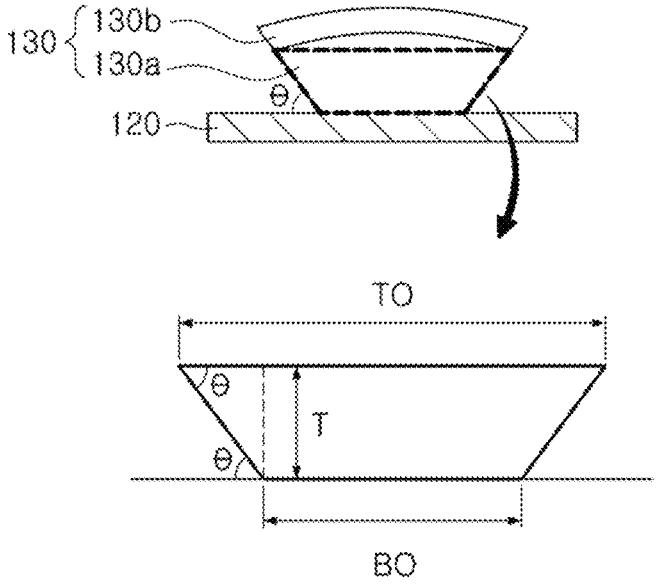
FIGS. 4 and 5 are enlarged views of region A in FIG. 3, and are schematic views illustrating measurements of a side inclination angle of a via.
Figure 5:
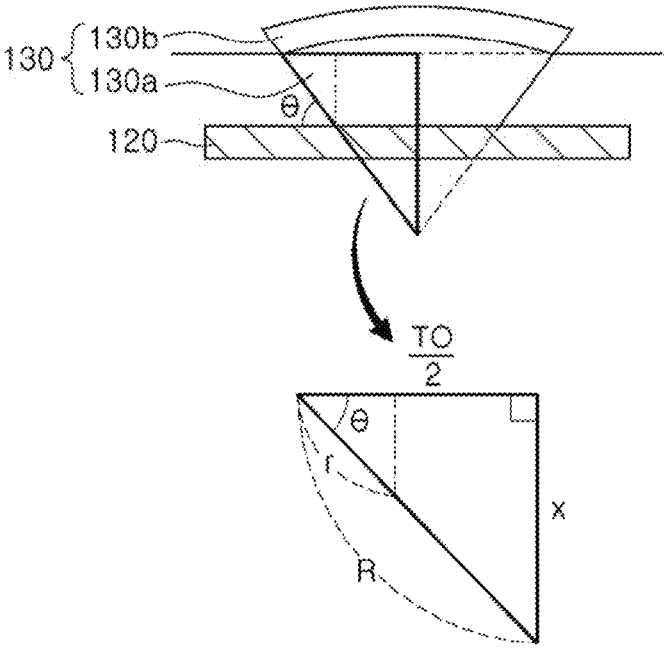

FIGS. 4 and 5 are enlarged views of region A in FIG. 3, and are schematic views illustrating measurement of a side inclination angle of the via.

With reference to FIGS. 4 and 5, in a via 130 having a form in which a transverse cross-sectional area of an upper portion thereof is greater than that of a lower portion thereof according to an exemplary embodiment, a case in which a cross sectional shape of the via 130 is a fan shape is illustrated.

The via 130 having a fan shaped cross-section may have a predetermined taper, and an inclination angle [θ] of a side surface of the via 130 having an inverted trapezoidal shape indicated by a dashed line may be adjusted to be maintained at a predetermined angle with respect to a bottom surface, and thus, a relatively wide cross-sectional area may be secured when coils are joined.

According to an exemplary embodiment, the inclination angle [θ] of the side surface of the via 130 may have an angle of 40 degrees to 70 degrees to secure a greater arc than a diameter of atop opening thereof.

In detail, the inclination angle [θ] of the side surface of the via 130 may have an angle of 50 to 60 degrees in some examples.

Hereinafter, a method of measuring and determining an inclination angle [θ] of the side surface of the via 130 will be described in detail.

The inclination angle θ of the side surface of the via 130 may be obtained by measuring a diameter of a top opening (TO) and a diameter of a bottom opening (BO) of the via 130, and a thickness (T) of an insulating material as illustrated in FIG. 4.

In more detail, the inclination angle θ of the side surface of the via 130 may be calculated, by substituting values of diameters of the top opening (TO) and the bottom opening (BO) of the via 130, and the thickness T of the insulating material, in the following equation.

$$\theta = \tan^{-1}\frac{T}{\frac{(TO - BO)}{2}} \qquad \text{Equation 1}$$

-continued $$\text{Taper} = \frac{(TO - BO)}{T} \qquad \text{Equation 2}$$

FIG. 5 is a schematic view for detailed analysis of the via by measuring lengths of respective portions of a fan-type via 130. In detail, FIG. 5 is a schematic view illustrating that a fan shape is completed by extending to a point at which virtual extension lines starting from both apexes of a lower opening of the fan-type via meets.

In this case, r is a lateral length of the via having a predetermined level of taper, R is a lateral distance from the top opening to the point at which the virtual extension lines meet each other, and X represents a vertical distance from the top opening to the point at which the virtual extension lines meet.

Table 1 below illustrates measured values of respective portions, and values of an inclination angle [θ] of the side surface of via 130, taper and arc of the via 130, calculated through Equations 1 and 2 above.

TABLE 1

| Top | Bottom | Thickness | Top − Bottom | r | R | x | Angle | tanθ | Taper | Arc |
|---|---|---|---|---|---|---|---|---|---|---|
| 0.0037 | 0.003 | 0.00080 | 0.0007 | 0.00087 | 0.0046 | 0.0042 | 66.4 | 2.285714 | 0.88 | 0.00381 |
| 0.0036 | 0.003 | 0.00080 | 0.0006 | 0.00085 | 0.0051 | 0.0048 | 69.4 | 2.666667 | 0.75 | 0.00368 |
| 0.0035 | 0.003 | 0.00080 | 0.0005 | 0.00084 | 0.0059 | 0.0056 | 72.6 | 3.2 | 0.63 | 0.00355 |
| 0.0034 | 0.003 | 0.00080 | 0.0004 | 0.00082 | 0.0070 | 0.0068 | 76.0 | 4 | 0.50 | 0.00343 |
| 0.0033 | 0.003 | 0.00080 | 0.0003 | 0.00081 | 0.0090 | 0.0088 | 79.4 | 5.333333 | 0.38 | 0.00332 |
| 0.0032 | 0.003 | 0.00080 | 0.0002 | 0.00081 | 0.0129 | 0.0128 | 82.9 | 8 | 0.25 | 0.00321 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.003 | 0.00080 | 0.0007 | 0.00087 | 0.0046 | 0.0042 | 66.4 | 2.285714 | 0.88 | 0.00381 |
| 0.0037 | 0.0027 | 0.00080 | 0.001 | 0.00094 | 0.0035 | 0.0030 | 58.0 | 1.6 | 1.25 | 0.00390 |
| 0.0037 | 0.0027 | 0.00080 | 0.001 | 0.00094 | 0.0035 | 0.0030 | 58.0 | 1.6 | 1.25 | 0.00390 |
| 0.0037 | 0.0027 | 0.00080 | 0.001 | 0.00094 | 0.0035 | 0.0030 | 58.0 | 1.6 | 1.25 | 0.00390 |
| 0.0037 | 0.0027 | 0.00080 | 0.001 | 0.00094 | 0.0035 | 0.0030 | 58.0 | 1.6 | 1.25 | 0.00390 |
| 0.0036 | 0.0027 | 0.00080 | 0.0009 | 0.00092 | 0.0037 | 0.0032 | 60.6 | 1.777778 | 1.13 | 0.00376 |
| 0.0036 | 0.0027 | 0.00080 | 0.0009 | 0.00092 | 0.0037 | 0.0032 | 60.6 | 1.777778 | 1.13 | 0.00376 |
| 0.0036 | 0.0027 | 0.00080 | 0.0009 | 0.00092 | 0.0037 | 0.0032 | 60.6 | 1.777778 | 1.13 | 0.00376 |
| 0.0036 | 0.0027 | 0.00080 | 0.0009 | 0.00092 | 0.0037 | 0.0032 | 60.6 | 1.777778 | 1.13 | 0.00376 |
| 0.0036 | 0.0027 | 0.00050 | 0.0009 | 0.00067 | 0.0027 | 0.0020 | 48.0 | 1.111111 | 1.80 | 0.00394 |
| 0.0036 | 0.0027 | 0.00060 | 0.0009 | 0.00075 | 0.0030 | 0.0024 | 53.1 | 1.333333 | 1.50 | 0.00386 |
| 0.0036 | 0.0027 | 0.00070 | 0.0009 | 0.00083 | 0.0033 | 0.0028 | 57.3 | 1.555556 | 1.29 | 0.00380 |
| 0.0036 | 0.0027 | 0.00080 | 0.0009 | 0.00092 | 0.0037 | 0.0032 | 60.6 | 1.777778 | 1.13 | 0.00376 |
| 0.0036 | 0.0027 | 0.00090 | 0.0009 | 0.00101 | 0.0040 | 0.0036 | 63.4 | 2 | 1.00 | 0.00373 |
| 0.0036 | 0.0027 | 0.00100 | 0.0009 | 0.00110 | 0.0044 | 0.0040 | 65.8 | 2.222222 | 0.90 | 0.00371 |
| 0.0036 | 0.0027 | 0.00067 | 0.0009 | 0.00081 | 0.0032 | 0.0027 | 56.1 | 1.488889 | 1.34 | 0.00382 |

Referring to Table 1, numerical values disclosed in the lower portion thereof represent an average value of the entire data of each item. It may be seen that as a thickness of an insulating layer decreases, an arc size may be greater than a diameter of a top opening.

Based on the data in the above Table 1, in the case of the via having a form in which a transverse cross-sectional area of an upper portion thereof is greater than that of a lower portion thereof, a thickness of the insulating layer may be determined to allow interference of signals to be significantly reduced at the time of interlayer connection of coils, while increasing an interlayer connection area of coils by an arc having a predetermined size or more.

According to an exemplary embodiment, a thickness of the insulating layer allowing interference of signals to be significantly reduced at the time of interlayer connection of coils, while increasing an interlayer connection area of coils, may be 5 to 10 μm.

In the exemplary embodiment, the thickness of the insulating layer allowing interference of signals to be significantly reduced at the time of interlayer connection of coils, while increasing an interlayer connection area of coils, may be set to 7 μm.

If the thickness of the insulating layer exceeds 10 μm, supply of a plating liquid into the via may not be smooth, due to a relatively high height of the via, thereby resulting in non-plating failure.

On the other hand, if the thickness of the insulating layer is less than 5 μm, interlayer spacing between the coils may be reduced, and interference of electric signals may occur.

Table 2 below compares interlayer connection areas of the coils according to shapes of the via.

In the following Table 2, the comparative example is a case in which a cross-sectional shape of a via according to the related art is a quadrangle, Embodiment 1 is a first embodiment of the present disclosure in which a cross-sectional shape of a via is an inverted trapezoid, Embodiment 2 is a second embodiment of the present disclosure in which a cross-sectional shape of a via is a fan type.

TABLE 2

| | Diameter (μm) | Contact Area ($\mu m^2$) | Contact area increase rate compared to comparative example (%) |
|---|---|---|---|
| Comparative Example | 27 | 572.6 | 0 |
| Embodiment 1 | 36 | 1017.9 | 178 |
| Embodiment 2 | 37.19 | 1086.3 | 190 |

Referring to Table 2, it may be seen that the interlayer connection areas of the coils are increased to 178% and 190%, in the case of the first and second embodiments, respectively, as compared with the comparative example in which the cross-sectional shape of the via is quadrangular.

Hereinafter, a method of manufacturing an inductor according to an exemplary embodiment will be described in detail.

A method of manufacturing an inductor according to an exemplary embodiment may include forming a coil pattern on a substrate; forming an insulating layer on the substrate to cover the coil pattern; forming a through-hole having an upper portion of which a transverse cross-sectional area is greater than that of a lower portion thereof, in the insulating layer; forming a first conductive layer within the through hole to exceed an upper surface of the insulating layer; forming a second conductive layer by printing a conductive paste on an upper portion of the first conductive layer; separating the substrate from the insulating layer including the coil pattern and the first and second conductive layers; and forming a body including a coil composed of the via including the coil pattern and the first and second conductive layers connected to the coil pattern by laminating a plurality of the separated insulating layers.

The insulating layer may be formed of at least one of a photosensitive resin, an epoxy resin, an acrylic resin, a polyimide resin, a phenol resin, and a sulfone resin.

For example, when the insulating layer is formed of a photosensitive resin, the through hole may be formed using a photoresist method, and when the insulating layer is formed of at least one of an epoxy resin, an acrylic resin, a polyimide resin, a phenol resin, and a sulfone resin, the through hole may be formed using a laser drilling method.

The through hole is printed or plated with a conductive paste to form a via, and the shape of the through hole according to an exemplary embodiment may be, for example, an inverted trapezoidal shape.

The first conductive layer 130*a* may be formed by a plating method and may be formed of a conductive metal. The conductive metal may be at least one of silver (Ag), copper (Cu), nickel (Ni), and tin (Sn), and for example, may be copper (Cu), but a material thereof is not limited thereto.

The second conductive layer 130*b* may be formed by printing a conductive paste containing conductive powder and an organic material.

The conductive paste may be one of a thermosetting-type paste and a low temperature sintering-type paste that may be sintered at 230° C. or less.

The conductive paste may include a conductive powder and an organic material. The conductive powder may be at least one of silver (Ag), copper (Cu), tin (Sn), and bismuth (Bi). The conductive powder may include two or more types of powder particles having different particle sizes. For example, the conductive powder may be in a form including, but not limited to, tin (Sn) or bismuth (Bi) having a particle size of 3 μm and silver (Ag) having a particle size of 1 μm.

The organic material may be at least one of a polymer and a flux. The organic material may be selected from, for example, epoxy, acrylate, and phenolic resin, but is not limited thereto.

FIGS. 6A to 6G are cross-sectional views schematically illustrating a method of manufacturing an inductor according to an exemplary embodiment, and illustrating a process of forming a via in detail.

Figure 6A:
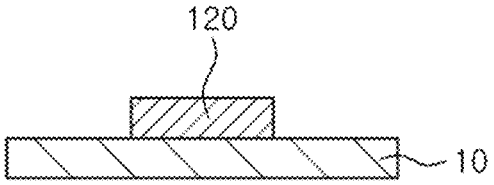
FIGS. 6A to 6G are schematic cross-sectional views illustrating process steps in a method of manufacturing an inductor according to an exemplary embodiment.

Referring to FIG. 6A, a coil pattern 120 may be formed on a substrate 10.

The substrate may be a copper clad laminate (CCL). The copper clad laminate is a laminated board for a printed wiring board, coated with a copper foil on one or both sides of a substrate, and in the case of the substrate, the substrate may be a phenol resin substrate, an epoxy resin substrate, or the like.

The coil pattern may be formed on the copper clad laminate through exposure and development.

The coil pattern may include a material including silver (Ag), copper (Cu), or alloys thereof, and for example, a material of the coil pattern may be copper (Cu), while not being limited thereto.

Figure 6B:
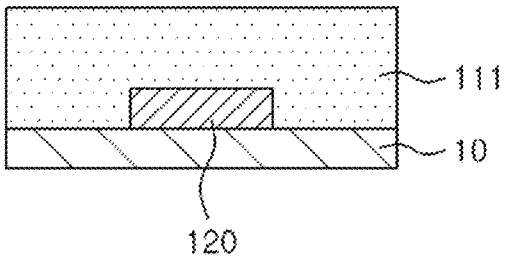
Figure 6C:
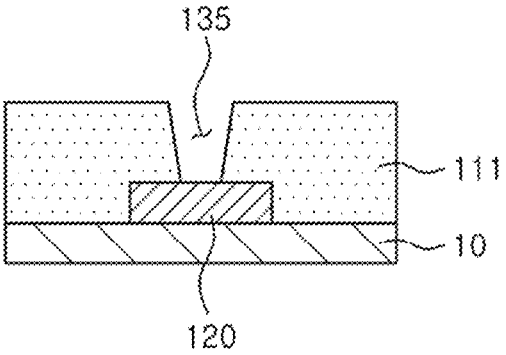

Referring to FIGS. 6B and 6C, an insulating layer 111 may be formed on the substrate 10 to cover the coil pattern 120, and a through hole 135 may be formed in the insulating layer 111.

The insulating layer 111 may be formed using a photosensitive resin. For example, when the insulating layer 111 is formed of a photosensitive resin, the through hole 135 may be formed using a photoresist (PR) process.

The through-hole 135 may be formed to contact the coil pattern while penetrating through the insulating layer 111.

In one example, when the insulating layer 111 is formed using negative type photoresist, a cross-section of the through hole 135 may have a trapezoidal shape. In another example, when the insulating layer is formed using positive type photoresist, the cross-section of the through-hole 135 may have an inverted trapezoidal shape, of which a length of an upper surface is greater than a length of a lower surface thereof.

According to an exemplary embodiment, the cross-section of the through hole 135 may be formed in such a manner that the insulating layer 111 is formed using a positive type photoresist, and may have an inverted trapezoidal shape of which a length of the upper surface of the through hole 135 is greater than a length of the lower surface of the through hole 135.

Figure 6D:
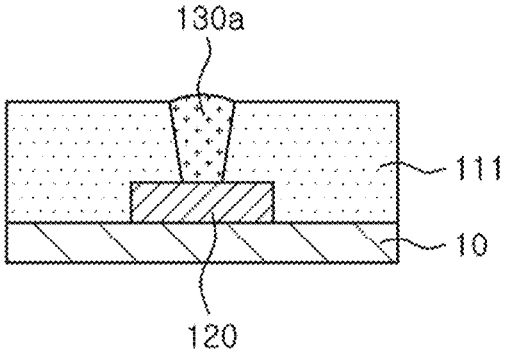

Referring to FIG. 6D, a first conductive layer 130*a* may be formed in the through-hole 135.

The first conductive layer 130*a* may be formed by an electroplating method, and may be formed of copper (Cu), but is not limited thereto.

The first conductive layer 130*a* may be formed via copper plating, to correspond to a thickness level of the insulating layer 111 and may be extended upwardly from an upper surface of the insulating layer 111 to have a fan shape.

Figure 6E:
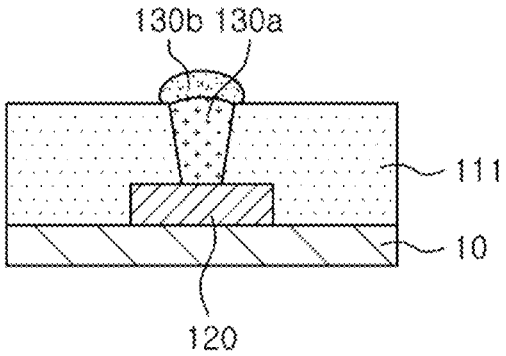

Referring to FIG. 6E, in order to compensate for a thickness variation of a copper (Cu) plated layer (e.g., the first conductive layer 130*a*), a tin (Sn) plating layer (e.g., which is the second conductive layer 130*b*) may be formed by forming tin (Sn), which may be easily deformed even under a relatively low load, on the first conductive layer 130*a* using an electroplating method.

The vias 130 may include the first and second conductive layers 130*a* and 130*b*.

The second conductive layer 130*b* may be formed using electroplating, but is not limited thereto. For example, the second conductive layer 130*b* may be formed by placing a conductive paste on a metal mask having a predetermined pattern and filling the inside of the through hole with the conductive paste using a squeegee.

The second conductive layer 130*b* may include a conductive powder and an organic material.

The conductive powder may be at least one of silver (Ag), copper (Cu), tin (Sn), and bismuth (Bi). The conductive powder may include two or more types of powder particles having different particle sizes.

The organic material may be at least one of a polymer and a flux.

Figure 6F:
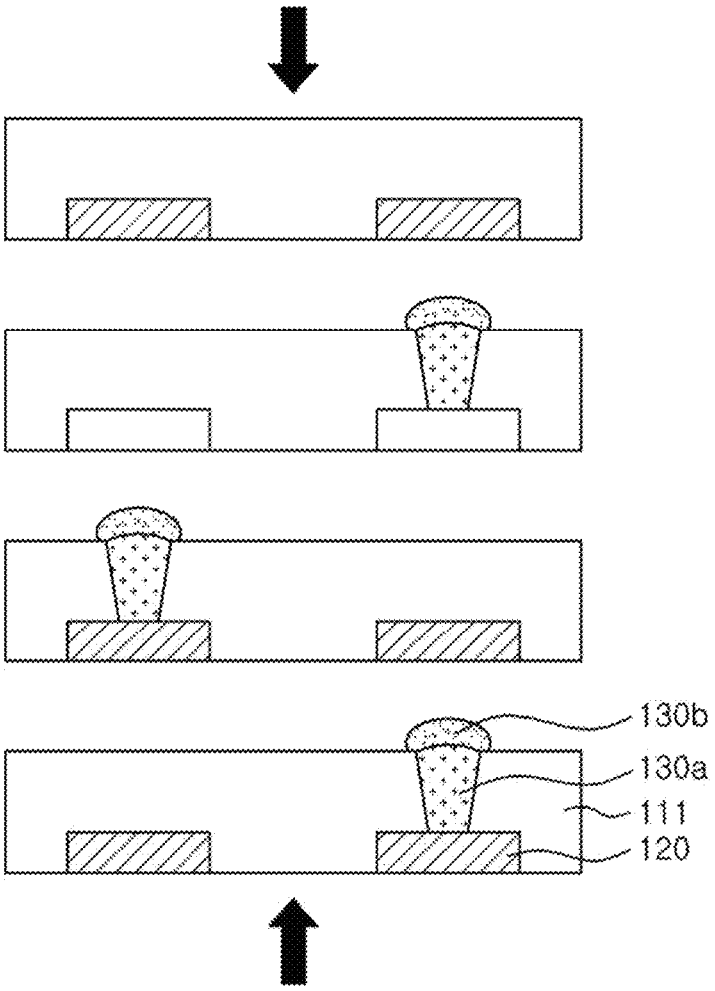
Figure 6G:
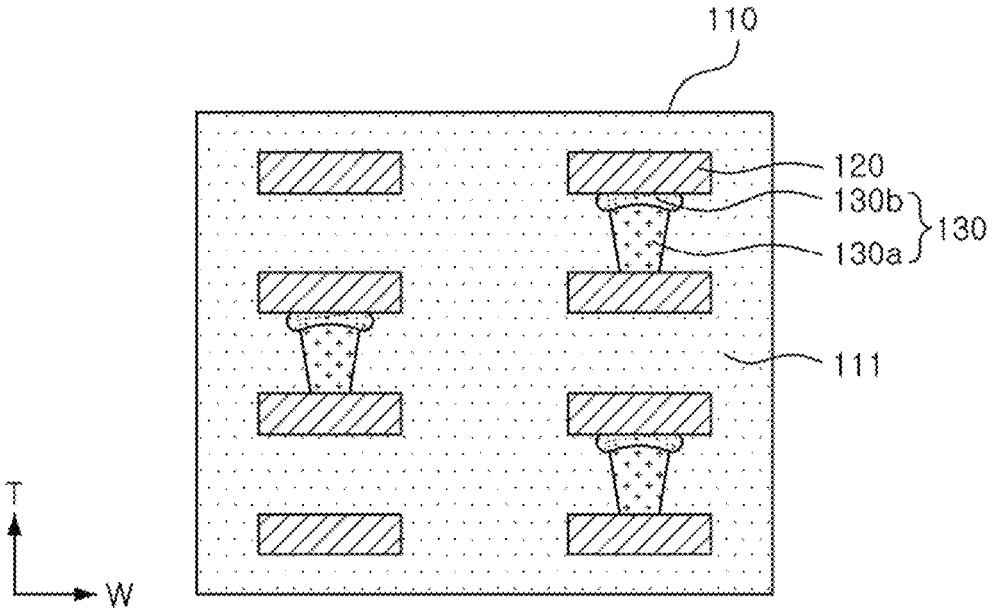

Referring to FIGS. 6F and 6G, the substrate 10 may be separated from the insulating layer 111 including the coil pattern and the first and second conductive layers 130*a* and 130*b*, and a plurality of separated insulating layers 111 may be laminated to form a body 110.

The substrate 10 may be removed using an etching method.

The separated plurality of insulating layers 111 may be laminated together, and the plurality of laminated insulating layers 111 may be pressed at a relatively high temperature to form the body 110.

In forming the body 110, sintering may be performed at a non-high temperature at which the insulating layer 111 and the second conductive layer 130*b* may be cured.

In addition, the body 110 may be formed by laminating the insulating layers 111 in multiple layers and thermally pressing the insulating layers 111, so that insulation distances between the layers may be uniformly formed, thereby reducing resistance of coils and improving Q characteristics of an inductor.

In the case of the inductor according to an exemplary embodiment as described above, as the via 130 including the first and second conductive layers 130*a* and 130*b* has a form in which a cross section of an upper surface thereof is greater than that of a lower surface thereof, electrical characteristics and connection reliability may be improved due to an increase in an interlayer connection area of coils.

Thereafter, although not illustrated, external electrodes may be formed on two ends of the body 110.

The external electrode may be formed by dipping the body in an external electrode paste.

The external electrode paste may include a conductive powder, and the conductive powder may include, but is not limited to, a material containing at least one of silver (Ag) and copper (Cu), or an alloy thereof.

Figure 7:
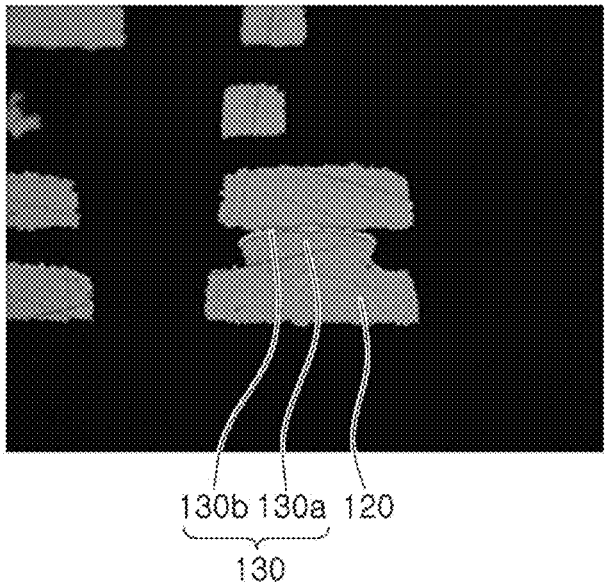
FIG. 7 is an image illustrating a cross-section of a via including first and second conductive layers in an inductor according to an exemplary embodiment.

FIG. 7 is an image illustrating a cross section of a via 130 including first and second conductive layers 130*a* and 130*b* in an inductor according to an exemplary embodiment.

Referring to FIG. 7, a height of the copper (Cu) layer (e.g., the first conductive layer 130*a*) may be adjusted to correspond to a thickness of the insulating layer using an electroplating method, and the copper (Cu) layer (e.g., the first conductive layer 130*a*) may be formed to have a round upper portion. Then, tin plating may be performed thereon to form the second conductive layer 130*b* thereon.

Accordingly, the via may have a form in which the first conductive layer 130*a* (e.g., a copper (Cu) layer), and the second conductive layer 130*b* (e.g., a tin (Sn) layer) formed on the first conductive layer 130*a*, are combined with each other.

In an exemplary embodiment, by forming a tin (Sn) metal, which may be easily deformed even under a relatively low load, on the copper (Cu) layer, thickness variations of the copper (Cu) layer at the time of interlayer bonding of the coils may be significantly reduced.

As set forth above, in the case of an inductor according to exemplary embodiments, as a via including first and second conductive layers has an upper portion of which a transverse cross-sectional area is greater than a transverse cross-sectional area of a lower portion thereof, an interlayer connection area of a coil is increased to improve electrical characteristics and connection reliability.

While exemplary embodiments have been shown and described above, it will be apparent to those skilled in the art that modifications and variations could be made without departing from the scope of the present invention as defined by the appended claims.

What is claimed is:

1. An inductor comprising:

a body having a coil disposed therein, the coil including first and second coil patterns connected by a via, wherein the via includes a first conductive layer and a second conductive layer disposed on the first conductive layer, the first conductive layer has an upper portion having a transverse cross-sectional area that is greater than a transverse cross-sectional area of a lower portion of the first conductive layer, and a surface of the upper portion of the first conductive layer contacting the second conductive layer, has a convex arced surface.

2. The inductor of claim 1, wherein a contact area of an upper portion of the via contacting the first coil pattern is greater than a contact area of a lower portion of the via contacting the second coil pattern.

3. The inductor of claim 1, wherein a side surface of the via, in a cross-section of the body taken in a thickness direction, is inclined at an angle of 40 to 70 degrees relative to a lower surface of the via contacting the second coil pattern.

4. The inductor of claim 1, wherein a thickness of an insulating layer between the first coil pattern and the second coil pattern adjacent to the first coil pattern is 5 μm to 10 μm, in a cross-section of the body in the thickness direction.

5. The inductor of claim 1, wherein the first conductive layer of the via has a fan-shaped transverse cross-section in a thickness direction of the body.

6. The inductor of claim 1, wherein the first conductive layer and the second conductive layer have a fan-shaped cross-section in a thickness direction of the body.

7. The inductor of claim 1, wherein the second conductive layer comprises a conductive powder and an organic material.

8. The inductor of claim 7, wherein the conductive powder is at least one of silver (Ag), copper (Cu), tin (Sn), and bismuth (Bi).

9. The inductor of claim 7, wherein the conductive powder comprises two or more types of powder particles having different particle sizes.

10. The inductor of claim 7, wherein the organic material is at least one of a polymer and a flux.

11. The inductor of claim 1, wherein the body is formed of an insulating material.

12. The inductor of claim 11, wherein the insulating material is at least one of a photosensitive resin, an epoxy resin, an acrylic resin, a polyimide resin, a phenol resin, and a sulfone resin.

13. A method of manufacturing an inductor, comprising:
forming a coil pattern on a substrate;
forming an insulating layer on the substrate to cover the coil pattern;
forming, in the insulating layer, a through-hole having an upper portion having a transverse cross-sectional area that is greater than a transverse cross-sectional area of a lower portion of the through-hole, wherein the lower portion of the through-hole contacts the coil pattern;
forming a via by:
forming a first conductive layer within the through hole, to have an upper portion having a convex arced surface, to have a transverse cross-sectional area of the upper portion that is greater than a transverse cross-sectional area of a lower portion thereof, and to exceed an upper surface of the insulating layer; and
forming a second conductive layer by printing a conductive paste on the upper portion of the first conductive layer having the convex arced surface;
separating the substrate from the insulating layer including the coil pattern and the via comprising the first and second conductive layers; and
forming a body including a coil composed of the coil pattern and the via connected to the coil pattern by laminating a plurality of the separated insulating layers.

14. The method of claim 13, wherein a contact area of an upper portion of the via contacting a coil pattern of another separated insulating layer is greater than a contact area of a lower portion of the via contacting the coil pattern.

15. The method of claim 13, wherein an inclination of a side surface of the via, in a cross-section of the body taken in a thickness direction, has an angle of 40 degrees to 70 degrees relative to a lower surface of the via contacting the coil pattern.

16. The method of claim 13, wherein a thickness of the insulating layer between any one coil pattern and a coil pattern adjacent thereto in a thickness direction of the body is 5 μm to 10 μm.

17. The method of claim 13, wherein the first conductive layer of the via has a fan-shaped cross-section in a thickness direction of the body.

18. The method of claim 13, wherein the first conductive layer and the second conductive layer have a fan-shaped cross-section in a thickness direction of the body.

19. A body comprising:
first and second conductive patterns disposed in different planes; and
a conductive via extending between and electrically connecting the first and second conductive patterns,
wherein the conductive via includes a first conductive layer and a second conductive layer disposed on the first conductive layer,
the first conductive layer has an upper portion having a transverse cross-sectional area that is greater than a transverse cross-sectional area of a lower portion of the first conductive layer,
a surface of the upper portion of the first conductive layer contacting the second conductive layer has a convex arced surface, and
a contact area of the conductive via with the first conductive pattern is larger than a contact area of the conductive via with the second conductive pattern.

20. The body of claim 19, wherein the conductive via is tapered between the contact area of the conductive via with the first conductive pattern and the contact area of the conductive via with the second conductive pattern.

21. The body of claim 19, wherein a side surface of the conductive via is non-orthogonal to a surface of the second conductive pattern contacting the conductive via.

22. The body of claim 21, wherein the side surface of the conductive via is angled at an angle of 40 to 70 degrees relative to the surface of the second conductive pattern contacting the conductive via.

23. The body of claim 19, wherein the conductive via extends a distance of 5 μm to 10 μm between the first and second conductive patterns.

24. The body of claim 19, wherein the first conductive layer contacts the second conductive pattern, and the second conductive layer disposed on the first conductive layer contacts the first conductive pattern.

25. The body of claim 24, wherein the first and second conductive layers have different compositions.

26. The body of claim 25, wherein the first conductive layer is formed of metal, and the second conductive layer is formed of a mixture of metal powder particles and a polymer.

27. An inductor comprising:
a body formed of an insulating material;
a coil disposed in the body, the coil comprising first and second coil patterns connected by a conductive via; and
first and second electrodes disposed on external surfaces of the body and connected to respective ends of the coil,
wherein:
the conductive via comprises a first conductive layer contacting the first coil pattern, and a second conductive layer having a concave arced surface disposed on an arced surface of the first conductive layer, and the second conductive layer contacts the second coil pattern,
the first and second conductive layers have different compositions, and
the conductive via comprising the first and second conductive layers has a tapered profile gradually expanding between a small cross sectional area of the first conductive layer contacting the first coil pattern and a larger cross sectional area of the second conductive layer contacting the second coil pattern.

* * * * *